US006464013B2

(12) United States Patent
Bystedt

(10) Patent No.: US 6,464,013 B2
(45) Date of Patent: Oct. 15, 2002

(54) OIL WELL CASING CENTRALIZER COUPLING

(76) Inventor: Kenneth A. Bystedt, 5839 Old Seward Hwy., Anchorage, AK (US) 99518

( * ) Notice: Subject to any disclaimer, the term of this patent is extended or adjusted under 35 U.S.C. 154(b) by 0 days.

(21) Appl. No.: 09/792,612

(22) Filed: Feb. 23, 2001

(65) Prior Publication Data

US 2002/0117307 A1 Aug. 29, 2002

(51) Int. Cl.[7] ..... E21B 17/10
(52) U.S. Cl. ..... 166/380; 166/241.1; 175/325.2
(58) Field of Search ..... 166/241.1, 285, 166/380; 175/325.2

(56) References Cited

U.S. PATENT DOCUMENTS 4,595,058 A 6/1986 Nations 5,575,333 A * 11/1996 Lirette et al. ..... 166/241.1

OTHER PUBLICATIONS

P. 12, Ray Oil Tool Co. Catalog (undated). One page document.

* cited by examiner

*Primary Examiner*—William Neuder
(74) *Attorney, Agent, or Firm*—Michael J. Tavella

(57) ABSTRACT

A threaded coupling that has a pair of threaded ends. A number of rigid centralizer ribs are attached or formed on the coupler. Because the coupler has a small length, a special wrench-adapter is used to attach the coupler to the casing string. This adapter fits around the coupler and allows an ordinary wrench to hold the coupler while the casing string is being made up. The coupling also has a gas seal to contain natural gas within the casing without allowing leakage and a torque limiter to ensure that the coupler does not destroy the casing when the casing is rotated in the earth.

16 Claims, 5 Drawing Sheets

OIL WELL CASING CENTRALIZER COUPLING

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

The present invention relates to an oil well casing centralizer coupling for use in cementing operations.

2. Description of Related Art

The process of drilling for oil is a multi-step process. First, a bore hole is drilled into the ground using a drill bit and drill pipe. Drilling mud is used for lubrication and pressure control during the drilling operation. Then, a casing is inserted into the bore hole. The casing is typically constructed from a plurality of threadable connected tubular casing sections. Often the insertion process requires significant rotation and axial reciprocation of the casing within the bore hole due to the friction generated between the walls of the formation and the pipe couplings or centralizer devices. The casing is centralized within the bore hole and is cemented into place by cement between the inner diameter of the bore hole and the outer diameter of the casing. The cement displaces the heavy, sticky drilling mud left over from the drilling operation. Preferably, the casing is rotated and/or reciprocated longitudinally to promote a uniform distribution of cement around the casing along its length. Once the casing is cemented in place, a smaller pipe (tubing) may be inserted into the casing for oil removal.

To center the casing within the bore, the industry has been to use centralizing blade assemblies that are attached to the outside of the casing. These blade assemblies are positioned along the length of the casing at regular intervals and held in place with setscrews, clamping collars, and the like. One problem with these blade assemblies is that they commonly became loose due to the casing rotation and reciprocation. When the blade assemblies become loose, they often slide along the casing. When this happens, they tend to bunch up at one or more locations. This results in poor centralizing of the casing—and consequently, a poor cementing job. Another problem with these blade assemblies is that the setscrews often cut the casing as the blade assemblies slide under high torque rotation of the casing. These cuts reduce the integrity of the casing. Another problem with the prior art is that these devices do not address the need to promote smooth, non-turbulent, reduced-friction flow around the centralizer, allowing the sticky drilling mud to release, which reduces the pumping pressure.

Finally, the setscrew bodies tend to disrupt and unbalance the flow path of the cement around the casing sections, which also produces a poor cementing job.

An exemplary centralizer is the Lirette et al. centralizer of U.S. Pat. No. 5,575,333. This centralizer uses movable, flexible spring bows to space the casing from the sides of the bore hole. The Lirette et al. centralizer includes threaded ends that allow it to function as a casing coupling that connects sections of an inner casing within an outer casing.

However, such movable, flexible spring bows tend to prohibit the rotation of a casing within a bore hole because the spring bows are not typically able to withstand the high torque developed by rotation of the casing relative to the inner surface of the bore hole.

Other forms of centralizers use rigid blade assemblies, which have been used on drilling tool couplings with female threads on a first end and male threads on a second end. Examples of this design are found in the following U.S. Pat. No. 4,595,058 to Nations teaches a turbulence cementing sub. This device is placed in the casing string to act as a centralizer. The device has a number of ribs formed on the outside of the device. The ribs are laid out so that some are angled in one direction and others are angled in the opposite direction. This is claimed to create a turbulent effect in the cement that supposedly eliminates having to turn or reciprocate the pipe. However, the effect is to reduce the smooth flow of the cement, raise the pumping pressure and impede the displacement of the drilling mud.

U.S. Pat. No. 2,309,791 to Sanders is a coupling type device that is screwed into a pipe string. It has ribs to hold the pipe away from the walls of the well. U.S. Pat. No. 3,762,472 to Alexander Jr., is a cylindrical device that has a larger diameter than the pipe, but a smaller diameter than a coupling. This device is designed to slide on the pipe between couplings. The device has ribs attached to help center the pipe. The problem with this device is that the force on the device maybe such that it is slammed into the couplings, which can damage them. In addition, the device cannot be used in a flush line system because, in such a system, there are no couplings used. U.S. Pat. No. 5,697,442 to Baldridge teaches a float shoe or collar that has ribs to act as a centralizer. The Baldridge patent, however, covers a device for washing the well bore walls. Finally, U.S. Pat. No. 4,995,456 to Cornette et al. teaches a gravel packing system that uses spaces with helical ribs on them to help spread the gravel slurry around the casing. Although this operation appears to be similar to the cementing operation, it is quite different and exactly the opposite effect from that desired.

All these devices have problems. Mostly, these problems arise because these centralizers are external add-ons to the casing. As such, they protrude into the well space, they do not hold their position in the well, and they dig into the casing surface when they move, and they do not allow cement to be applied uniformly to the casing. Moreover, their roughness and uncoated surfaces increase cement pumping pressure and lower flows leaving some of the drilling mud in place, which can lead to failed cementing and a non-usable well.

The devices that use some type of coupling with ribs are more effective, but tend to be large, excessively long and difficult to handle. Consequently, these ribs can increase flow restrictions. Moreover, all of these devices need some type of smooth cylindrical surface to accommodate a wrench when the device is placed into or removed from the string.

BRIEF SUMMARY OF THE INVENTION

The centralizer coupling of the present invention overcomes all these problems. It is able to withstand the high torque rotation and reciprocation of the casing without slippage, while allowing cement to flow smoothly, evacuating the drilling mud easily, reducing insertion and pumping pressures, and increasing cement flow rates.

The oil well casing centralizer of the present invention is a threaded coupling that has a pair of threaded ends. A number of rigid centralizer ribs are attached or formed on the coupler. Because the coupler has a small length, a special wrench-adapter is used to attach the coupler to the casing string. This adapter fits around the coupler and allows an ordinary wrench to hold the coupler while the casing string is being made up.

The coupling also has a gas seal to contain natural gas within the casing without allowing leakage and a torque limiter to ensure that the coupler does not destroy the casing when the casing is rotated in the earth.

DETAILED DESCRIPTION OF THE INVENTION

Figure 1:
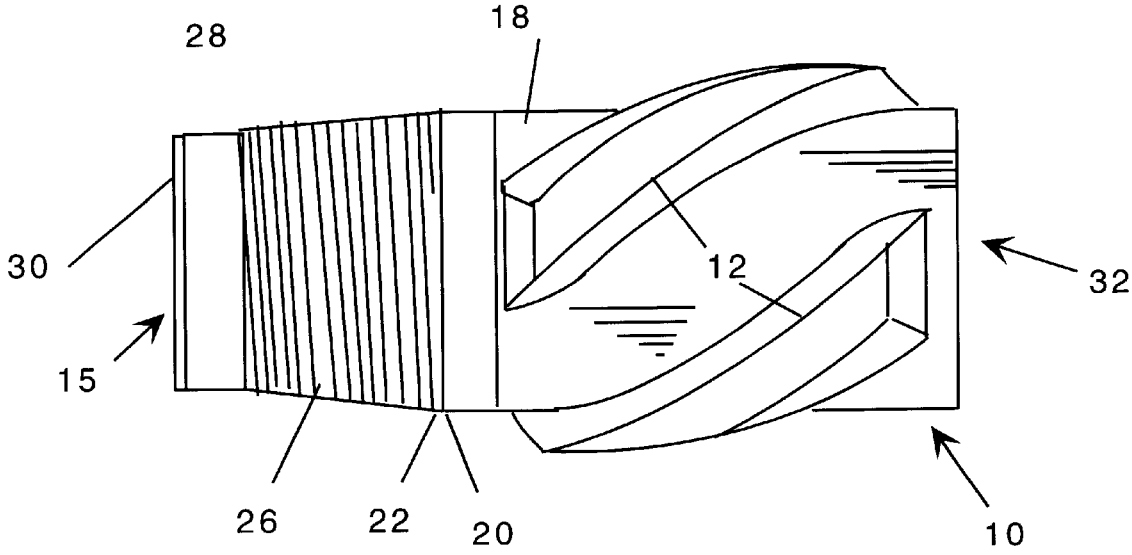
FIG. 1 is a side view of an embodiment of my coupler having male-female coupler threads.

Referring now to FIG. 1, a side view of my new coupler is shown. This device 10 has the length of a standard coupler. It has a set of threads on both ends to receive casing pipe. As shown, one end has a set of female threads and the other end has male threads. On the outer surface of the coupler are a number of helical ribs 12. These ribs extend outward from the coupler surface. The ribs 12 act as centralizers that hold the casing pipe away from the well bore walls. The use of these couplers 10 improves the efficiency of well installation. Because the couplers act as centralizers, there is no need to install any additional centeralizer components that can cause problems during the cementing process. Moreover, because the centralizers are couplers, they can be installed as part of the normal casing installation. Thus, by installing the couplers, the casing is also ready for cementing.

FIG. 1 shows a coupler that has a male coupling end 15 that preferably includes mating features such as a male external torque shoulder 20, a male external gas seal 22, male pin premium threads 24, a male first internal torque shoulder 26, a male internal gas seal 28, and a male second internal torque shoulder 30. At the other end of the coupling 10 is a female coupling end 32.

Figure 2:
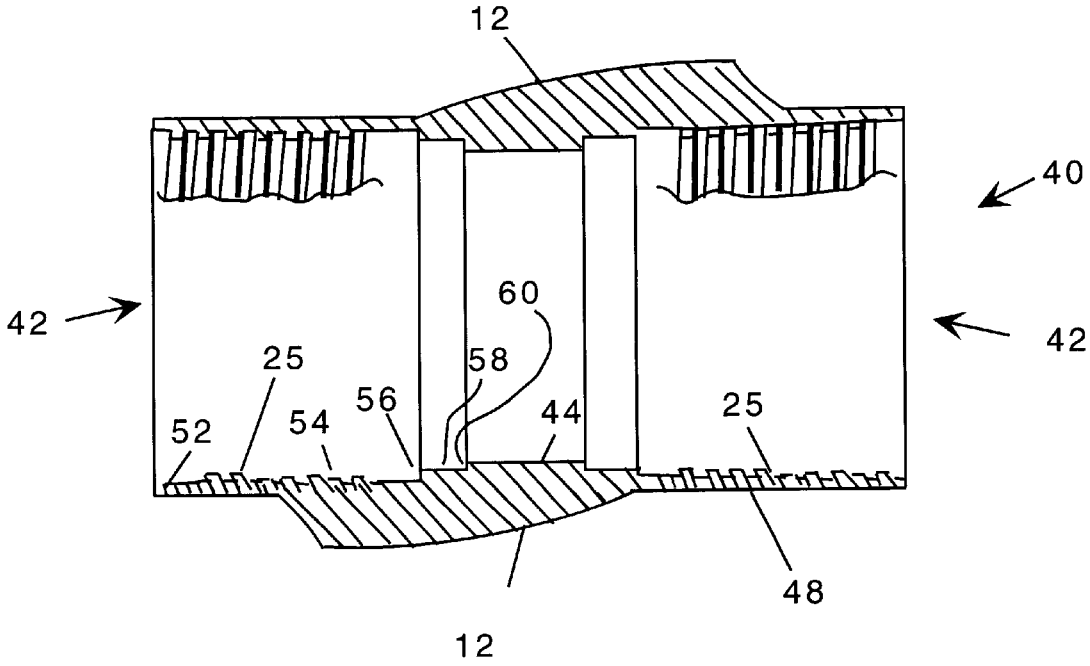
FIG. 2 is a cross-sectional side view of an embodiment of my coupler having female-coupler threads.

FIG. 2 shows a centralizer coupling 40 with two female coupling ends 42. Each of the coupling ends 42 are fitted with premium threads 25 as shown. To mate with the female coupling ends 42, the ends of the casing sections have male casing ends similar to the male coupler end 15 of the coupler 10 of FIG. 1. Between the two ends is a hollow through-bore 44. Each female coupling end 42 preferably includes several features that optimize the suitability of bladed couplings for cementing operations. As shown, each female coupling end 42 preferably includes a female external torque shoulder 50 for resisting high tightening torque by abutting the end of the coupled casing, a female tapered external gas seal 52, female box premium threads 54, a female first internal torque shoulder 56, a female tapered internal gas seal 58, and a female second internal torque shoulder 60. However, a lesser number of torque shoulders and gas seals could be suitable for many applications.

As shown if FIGS. 1 and 2, the centralizer couplers are the same size as ordinary couplers. The centralizer couplings have a plurality of rigid blades 12 fixedly attached to the exterior of the body 18 of the coupling 10 and 48 on coupler 40

The rigid blades 12, as mentioned above, are fixedly attached and made integral with the bodies of the couplers by welding the blades 12 to the coupler body, machining the blades 12 and body, or casting the blades 12 and body, all as a single unit.

Figure 3:
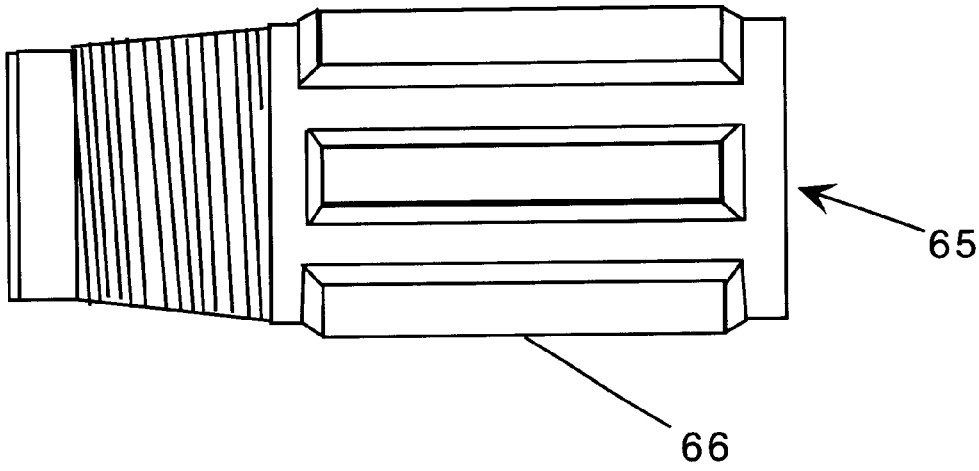
FIG. 3 is a side view of a second embodiment of the coupler.

As shown if FIG. 3, although the preferred embodiment has ribs that helical, other embodiments may be made with spiral ribs, diagonal ribs, straight ribs, or other configurations. For example, FIG. 3 shows an embodiment 65 that has straight ribs 66.

Typically, an ordinary coupler is attached to the casing string using a wrench to hold it while the threads are engaged. Because the centralizer couplers have the helical ribs running almost the entire length of the coupling, an ordinary wrench cannot be used to make up the connection. As such, there is no way to install or remove one of these centralizers in the field.

Figure 4:
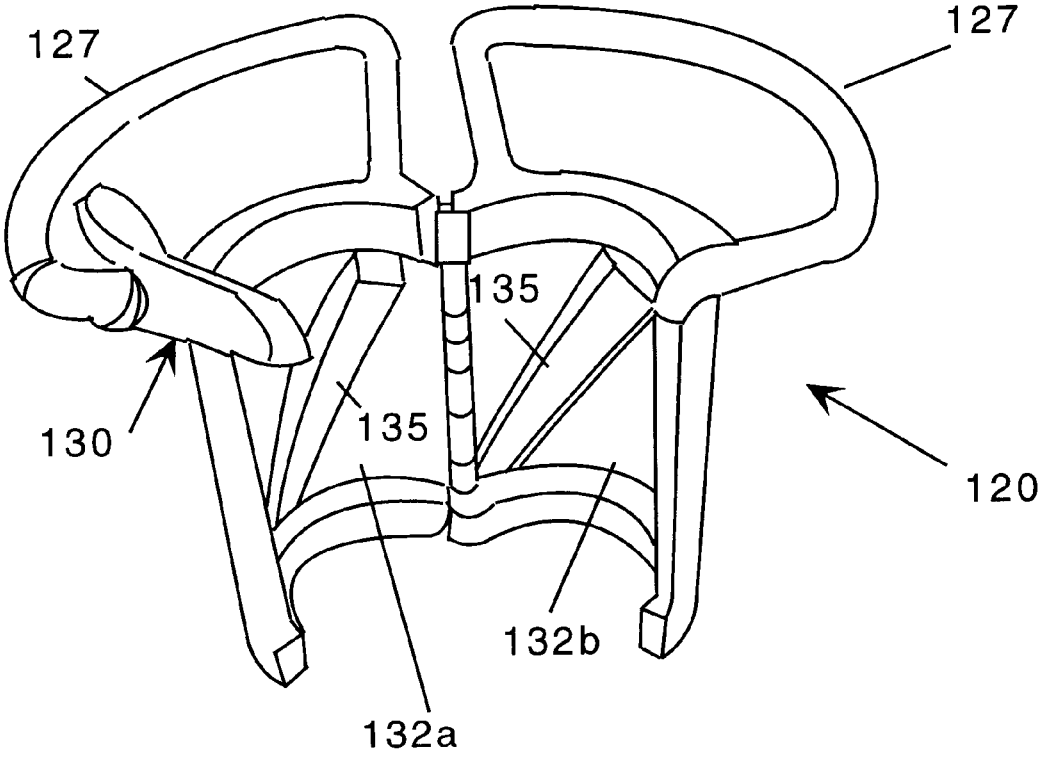
FIG. 4 is a perspective view of the wrench adapter in the open position.
Figure 5:
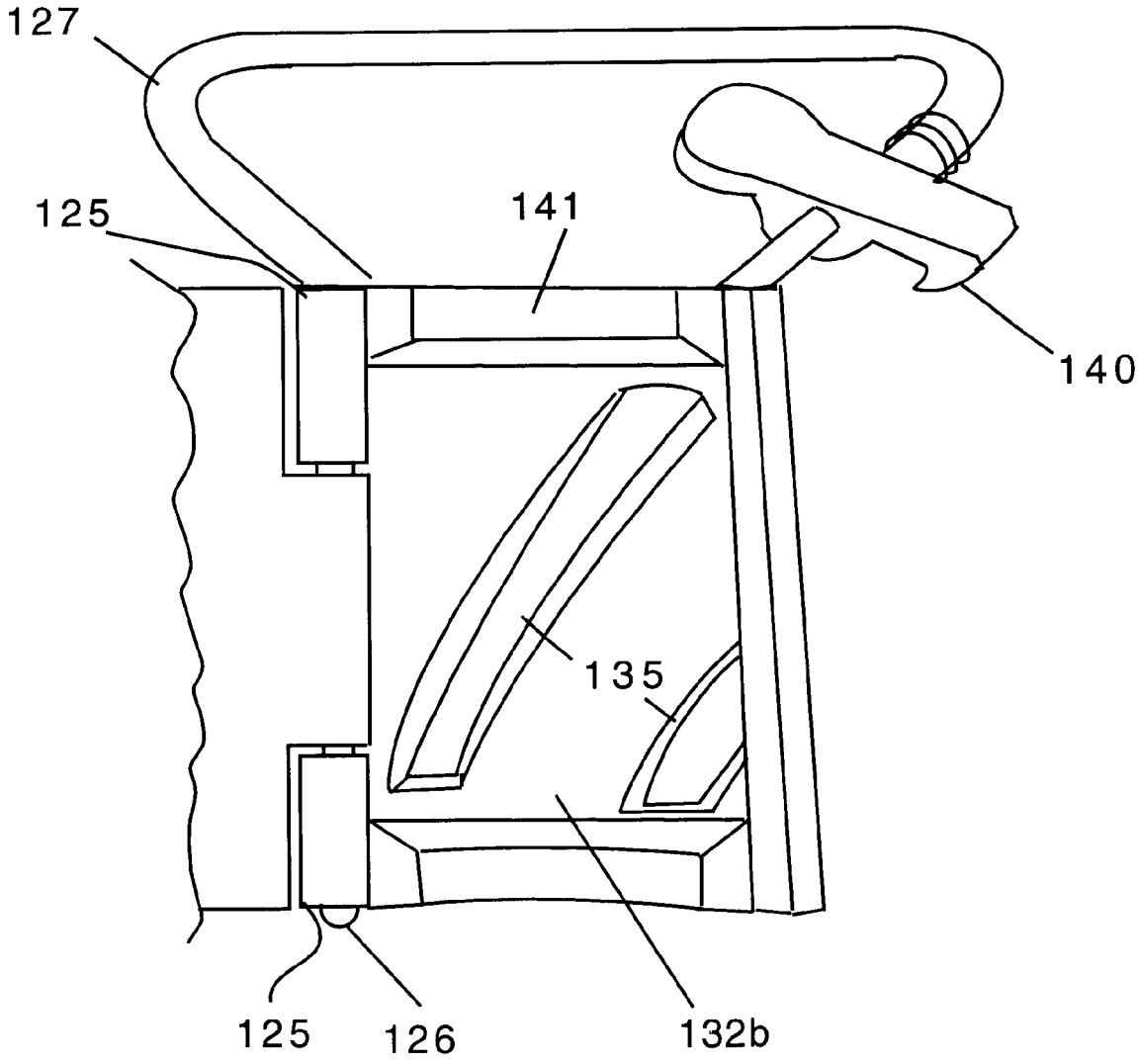
FIG. 5 is a detail view of a portion of the wrench adapter.
Figure 6:
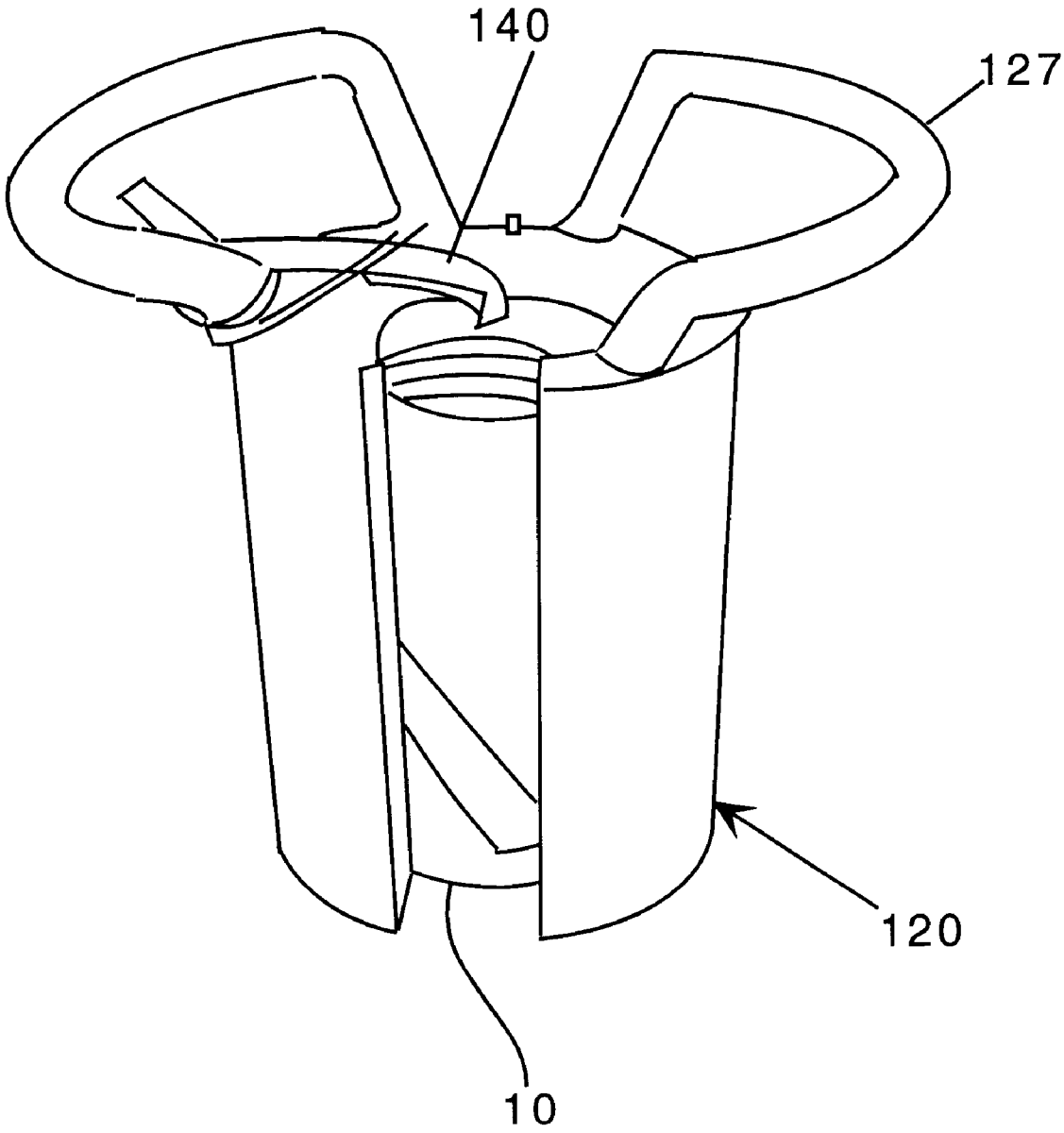
FIG. 6 is a perspective view of the wrench adapter in a partially closed position, showing a coupling in place.

In the present embodiment, however, a wrench adapter is used to attach and remove the centralizers. FIGS. 4, 5 and 6 show the wrench adapter 120. It has a cylindrical body that is made of two halves. The two halves are brought together and hinges 125 are installed on one side. In this way, the adapter can be opened and closed. Two handles 127 are provided to allow a user install remove the adapter. A latching mechanism 130 (discussed below) is used to lock the adapter in the closed position. FIG. 4 also shows an inside wall 132*b* of the wrench adapter. The opposite inside wall has a similar configuration. As shown, the adapter has a number of helical grooves 135 formed in the sidewall. These grooves mesh with the ribs on the centralizer couplers and permit the adapter to close around the couplers.

When the coupler 10 is locked within the adapter, it can be positioned on the casing string. Because the wrench adapter has a smooth outer surface, an ordinary wrench can hold the adapter in place while the coupler is installed. See, e.g., FIG. 7. Once the centralizer is installed, the adapter is removed and the casing can be inserted into the well. At the next centralizer placement, the process is repeated.

FIG. 5 shows details of one side of the adapter 120. On the handle 127 is a thumb release latch 140 that is part of the release mechanism 130. Inside the adapter is an upper lateral shoulder stop 141 that conforms to the ridge on the centralizer. At the bottom of the hinge 125 is a hinge pin 126 as shown.

FIG. 6 shows a centralizer 10 within the adapter 120. In this view, the adapter is not quite fully closed. The thumb latch 140 is shown approaching the handle 127, where it can latch the adapter closed.

Figure 7:
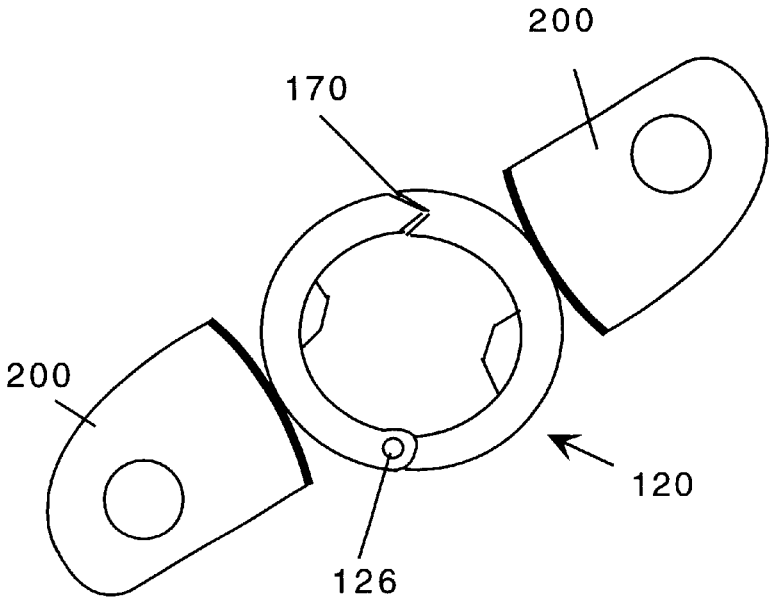
FIG. 7 is a bottom view of the closed wrench adapter showing placement of wrench jaws on the adapter.

FIG. 7 shows a bottom view of the closed adapter 120 positioned between a set of wrench jaws 100. Note that the hinge pin 126 is designed to be loose fitting, which allows no load to be applied to the pin under radial load conditions. Also, note that the ends 170 of the adapter come together in a chevron patter that is designed to prevent distortion under radial loads. This ensures that the centralizer is installed on the casing without deformation and that the adapter can be installed and removed quickly and easily for every operation.

Figure 8:
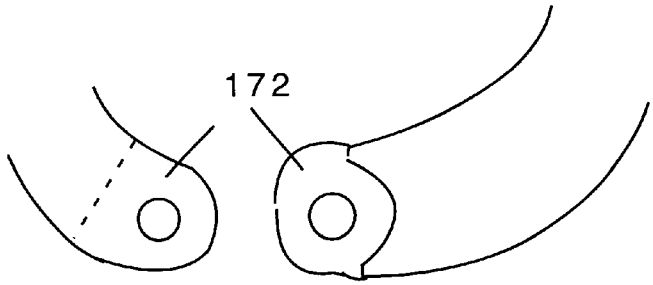
FIG. 8 is a detail view of the hinge portion of the adapter.

FIG. 8 is a detail of the hinge showing the radial load contact surfaces 172 of the hinge.

Figure 9:
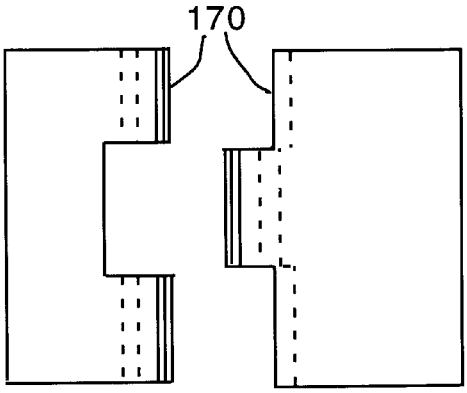
FIG. 9 is a detail side view of one of the hinge portions of the adapter.

FIG. 9 is a detail side view of the adapter showing the radial load contact surfaces 170 for the adapter.

The method for using the centralizer coupler 10 begins with connecting at least two sections of casing together by means of a centralizer coupling 10 between the pair of casing sections. The centralizer is placed within the wrench adapter 120, which is then closed. The adapter and centralizer are then placed on the lower casing. A wrench is then applied to the adapter and the upper section of casing is attached. The wrench and adapter are removed and the casing is ready for installation into the well.

Next, the connected casing is inserted into a drilled bore hole and further casing sections are connected in series by further centralizer couplings as needed. The step of inserting the casing into the bore hole may include rotating and reciprocating the casing within the bore hole. The ribs center the casing within the bore hole, and cannot slide longitudinally along the casing or rotatably around the casing because they are an integral part of a coupling. Cement is then inserted into the bore hole between the inner diameter of the bore hole and the outer diameter of the casing. The casing may be rotated and/or longitudinally reciprocated to cause turbulence and otherwise assist the cement in flowing into the bore hole and distributing uniformly around the casing along its length. The cement is then allowed to cure around the centralized casing.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An oil well casing centralizer, comprising:

a) a threaded coupling having an outer surface having a length, a pair of axially aligned ends jointed by a hollow passageway and having coupling threads adjacent to each of said pair of axially aligned ends;

b) a plurality of rigid centralizer ribs fixedly attached to the outer surface of said oil well casing centralizer, whereby said plurality of ribs extends over the length of said outer surface such that there is no wrench-gripping surface on said outer surface of said oil well casing centralizer whereby the plurality of ribs are formed in a helical pattern about said outer surface of said oil well casing centralizer; and c) a wrench adapter, removably attached to said oil well casing centralizer for allowing said oil well casing centralizer to be installed in a casing string.

2. The oil well casing centralizer of claim 1 wherein said coupling threads have at least one gas seal adjacent thereto.

3. The oil well casing centralizer of claim 1 wherein said coupling threads have at least one torque shoulder adjacent thereto.

4. The oil well casing centralizer of claim 1 wherein the coupling threads are female threads.

5. The oil well casing centralizer of claim 1 wherein the coupling threads have one male thread set and one female thread set.

6. The oil well casing centralizer of claim 1 wherein the wrench adapter has an inside and an outside, and further wherein said inside is adapted to close about said plurality of ribs; and further wherein said outside has a smooth, wrench-gripping surface.

7. The oil well casing centralizer of claim 6 further comprising means for securing said wrench adapter around said oil well casing centralizer.

8. An oil well casing centralizer, comprising:

a) a threaded coupling having an outer surface having a length, a pair of axially aligned ends jointed by a hollow passageway and having coupling threads adjacent to each of said pair of axially aligned ends;

b) a plurality of rigid centralizer ribs fixedly attached to the outer surface of said oil well casing centralizer, whereby said plurality of ribs extends over the length of said outer surface such that there is no wrench-gripping surface on said outer surface of said oil well casing centralizer;

c) a wrench adapter, adapted for use with said oil well casing centralizer; said wrench adapter including:

i) a pair of semi-cylindrical members;

ii) a hinge for hingably joining said pair of semi-cylindrical members together;

iii) an inside surface, having a plurality of rib bodies, whereby said plurality of rib bodies is configured to interconnect with said plurality of ribs on said oil well casing centralizer;

iv) a smooth, wrench gripping outer surface; and v) a means for locking said wrench adapter around said oil well casing centralizer.

9. The oil well casing centralizer of claim 8 whereby the plurality of ribs are formed in a helical pattern about said outer surface of said oil well casing centralizer.

10. The oil well casing centralizer of claim 8 wherein said coupling threads have at least one gas seal adjacent thereto.

11. The oil well casing centralizer of claim 8 wherein said coupling threads have at least one torque shoulder adjacent thereto.

12. The oil well casing centralizer of claim 8 wherein the coupling threads are female threads.

13. The oil well casing centralizer of claim 8 wherein the coupling threads have one male thread set and one female thread set.

14. A method of using an oil well casing centralizer comprising the steps of:

a) coupling at least two tubular casing sections operatively together with a hollow centralizer, said hollow centralizer having a plurality of ribs and no wrench gripping surface, to form a casing;

b) using a wrench adapter to attach said hollow centralizer into said casing;

c) inserting said casing into a bore hole, said bore hole having a bore hole inner diameter; and d) inserting a quantity of cement between said casing outer diameter and said bore hole inner diameter by flowing said cement through said plurality of ribs and along said casing.

15. The method of claim 14 wherein said step of inserting said casing further includes the step of rotating said casing within said bore hole.

16. The method of claim 14 wherein said step of inserting said casing further includes the step of reciprocating said casing axially within said bore hole.

* * * * *